US011244597B2

(12) United States Patent
Lin et al.

(10) Patent No.: US 11,244,597 B2
(45) Date of Patent: Feb. 8, 2022

(54) DISPLAY DEVICE AND DRIVING PROTECTION METHOD THEREOF

(71) Applicant: E Ink Holdings Inc., Hsinchu (TW)

(72) Inventors: Huei-Jyun Lin, Hsinchu (TW); Chun-Ta Chien, Hsinchu (TW); Chia-Hao Kuo, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/180,692

(22) Filed: Feb. 19, 2021

(65) Prior Publication Data

US 2021/0295764 A1 Sep. 23, 2021

(30) Foreign Application Priority Data

Mar. 19, 2020 (TW) ..... 109109098
Dec. 30, 2020 (TW) ..... 109146832

(51) Int. Cl.
*G09G 3/20* (2006.01)

(52) U.S. Cl.
CPC ..... *G09G 3/2096* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 5,835,923 | A | 11/1998 | Shibata et al. | |
| 8,126,296 | B2 | 2/2012 | Watanabe et al. | |
| 8,723,889 | B2 | 5/2014 | Wang et al. | |
| 2012/0181333 | A1 | 7/2012 | Krawczewicz et al. | |
| 2016/0275907 | A1 | 9/2016 | Scott et al. | |
| 2019/0266964 | A1* | 8/2019 | Pan | G09G 3/3685 |
| 2020/0143721 | A1* | 5/2020 | Chu | H04L 1/242 |

* cited by examiner

*Primary Examiner* — Krishna P Neupane
(74) *Attorney, Agent, or Firm* — JCIPRNET

(57) ABSTRACT

A display device and a driving protection method thereof are provided. The display device includes a timing controller and a source driver. The timing controller encrypts a verification data to generate a first encryption signal. The source driver coupled to the timing controller receives the first encryption signal. The source driver decrypts the first encryption signal to obtain a first decryption data. The source driver encrypts the first decryption data to generate a second encryption signal. The source driver outputs the second encryption signal to the timing controller. The timing controller decrypts the second encryption signal to obtain a second decryption data. When the timing controller determines that the second decryption data matches the verification data, the timing controller enables the source driver to perform display driving.

11 Claims, 4 Drawing Sheets

100

DISPLAY DEVICE AND DRIVING PROTECTION METHOD THEREOF

CROSS-REFERENCE TO RELATED APPLICATION

This application claims the priority benefits of Taiwan application serial no. 109109098, filed on Mar. 19, 2020, and Taiwan application serial no. 109146832, filed on Dec. 30, 2020. The entirety of the above-mentioned patent applications is hereby incorporated by reference herein and made a part of this specification.

BACKGROUND

Technical Field

The disclosure relates to a display device, and more particularly to a display device with a driving protection mechanism and a driving protection method thereof.

Description of Related Art

With the development of display technology, many display devices characterized in slimness and power saving have been widely applied in daily life, such as liquid crystal display devices, electronic paper display devices, etc. Generally speaking, different types of display devices usually adopt different display media to generate images. Taking an electronic paper display device as an example, the display medium layer of the electronic paper display device is mainly configured by an electrophoretic fluid and charged white particles and black particles. By applying voltage to the display medium layer of the electronic paper display device, the white particles and the black particles may be moved to specific positions to display black, white, or different grayscale images.

In the related art, the electronic paper display device adopts a display driver to directly output an image signal to drive the electronic paper display panel. However, there may be an unauthorized analysis and copying of some confidential information (for example, the waveform control signal of the display panel) in the image signal. Therefore, the existing electronic paper display device has no security protection measures for image signals.

SUMMARY

The disclosure provides a display device and a driving protection method thereof, which may encrypt and protect confidential information in an image signal.

An embodiment of the disclosure provides a display device. The display device includes a timing controller and a source driver. The timing controller is configured to encrypt a verification data to generate a first encryption signal. The source driver is coupled to the timing controller and configured to receive the first encryption signal. The source driver decrypts the first encryption signal to obtain a first decryption data, and encrypts the first decryption data to generate a second encryption signal. The source driver outputs the second encryption signal to the timing controller. The timing controller decrypts the second encryption signal to obtain a second decryption data. When the timing controller determines that the second decryption data matches the verification data, the timing controller enables the source driver to perform display driving.

Another embodiment of the disclosure provides a driving protection method, adapted for a display device. The display device includes a timing controller and a source driver. The driving protection method includes: encrypting a verification data through a timing controller to generate a first encryption signal; receiving the first encryption signal through the source driver, and decrypting the first encryption signal to obtain a first decryption data; encrypting the first decryption data through the source driver to generate a second encryption signal, and outputting the second encryption signal to the timing controller; decrypting the second encryption signal through the timing controller to obtain a second decryption data; and when the timing controller determines that the second decryption data matches the verification data, enabling the source driver through the timing controller to perform display driving.

Based on the above, the display device in the embodiments of the disclosure includes a timing controller and a source driver. The timing controller may perform a verification operation on the source driver to determine whether the current source driver is a legitimate display driver. When the current source driver is confirmed as the legitimate display driver, the timing controller will enable the source driver to perform display driving. Therefore, the display device in the embodiments of the disclosure may provide full protection for some confidential information (for example, a waveform control signal of a display panel) in the image signal. In addition, the timing controller and the source driver in the embodiments of the disclosure have encryption protection functions. Therefore, when the verification operation is performed, it may be ensured that a verification signal transmitted between the timing controller and the source driver is not read by an external device.

DETAILED DESCRIPTION OF DISCLOSED EMBODIMENTS

The following will describe some embodiments as examples of the disclosure. However, the disclosure is not limited to the exemplified embodiments. Moreover, some embodiments may be combined where appropriate. The term "coupling (or connection)" as used throughout the present specification (including the claims) may refer to any direct or indirect connection means. For example, if it is described that a first device is coupled (or connected) to a second device, it should be interpreted that the first device can be directly connected to the second device, or the first device can be indirectly connected to the second device through other devices or a certain connection means. In addition, the term "signal" may refer to at least one current, voltage, charge, temperature, data, electromagnetic wave, or any other one or more signals.

Figure 1:
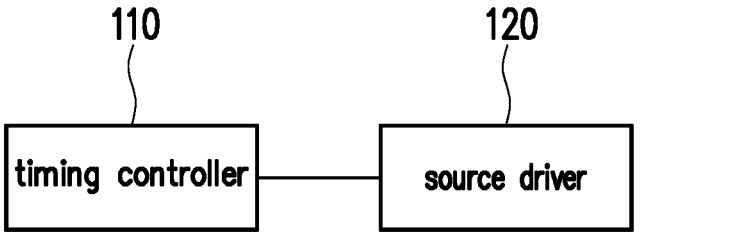
FIG. 1 is a schematic view of a display device according to an embodiment of the disclosure.

FIG. 1 is a schematic view of a display device according to an embodiment of the disclosure. Referring to FIG. 1, a display device 100 of this embodiment includes a timing controller 110 and a source driver 120. The timing controller 110 may provide a driving control signal adapted for the display device 100 to the source driver 120. The source driver 120 is coupled to the timing controller 110. The source driver 120 may receive the driving control signal, and perform display driving according to the driving control signal.

In the embodiment of FIG. 1, the display device 100 may be, for example, an electronic paper display device. In order to protect the driving control signal of the display device 100, the timing controller 110 may perform a verification operation on the source driver 120 to determine whether the source driver 120 is a legitimate display driver. When the source driver 120 is confirmed as the legitimate display driver, the timing controller 110 will enable the source driver 120.

Figure 2:
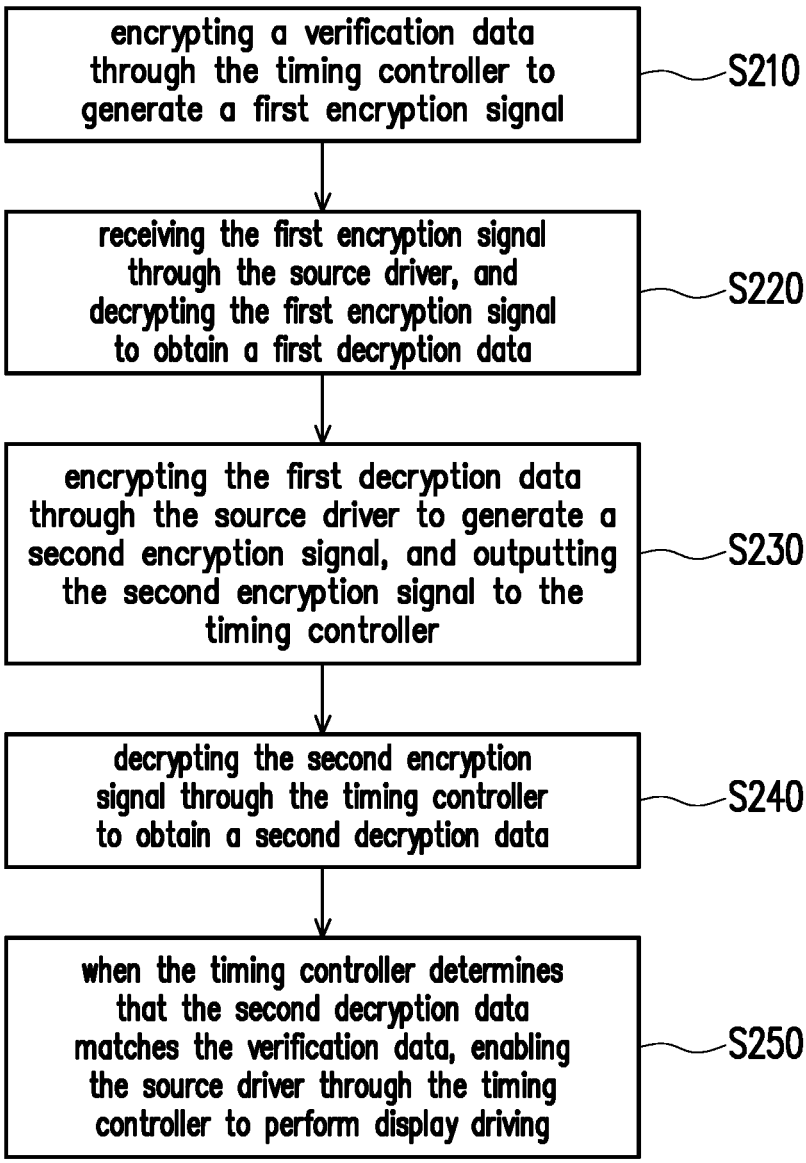
FIG. 2 is a schematic view of a driving protection method according to an embodiment of the disclosure.

The method through which the timing controller 110 performs the verification operation may be as shown in the embodiment of FIG. 2. FIG. 2 is a schematic view of a driving protection method according to an embodiment of the disclosure. Referring to FIG. 1 and FIG. 2, the timing controller 110 may adopt a verification data to determine whether the source driver 120 is a legitimate display driver. In addition, in order to improve the security of signal transmission, the timing controller 110 may encrypt the verification data in step S210 to generate a first encryption signal. The verification data may be, for example, a time parameter, a random number data, or a combination of the time parameter and the random number data stored in the timing controller 110.

In step S220, the source driver 120 may receive the first encryption signal and decrypt the first encryption signal to obtain a first decryption data. In order to improve the security of signal transmission, the source driver 120 may encrypt the first decryption data in step S230 to generate a second encryption signal and output the second encryption signal to the timing controller 110.

In the above embodiment, the timing controller 110 and the source driver 120 may respectively adopt different encryption transmission methods to output the first encryption signal and the second encryption signal, so as to increase the difficulty of decryption. For example, if the timing controller 110 adopts a parallel transmission method to output the first encryption signal to the source driver 120, the source driver 120 may adopt a serial transmission method to output the second encryption signal to the timing controller 110.

On the other hand, if the timing controller 110 outputs the first encryption signal to the source driver 120 through the serial transmission method, the source driver 120 may output the second encryption signal to the timing controller 110 through the parallel transmission method. In this way, even if the first encryption signal and the second encryption signal are captured by an unauthorized device during transmission, the unauthorized device cannot know the content of the verification data.

Referring to FIG. 1 and FIG. 2 again, the timing controller 110 may decrypt the second encryption signal in step S240 to obtain a second decryption data. The timing controller 110 may also compare the second decryption data with the verification data to determine whether the second decryption data matches the verification data. In step S250, when the timing controller 110 determines that the second decryption data matches the verification data, the timing controller 110 may enable the source driver 120 to perform display driving. Therefore, the disclosure may protect the driving control signal of the display device 100 through the above verification operation method.

Figure 3:
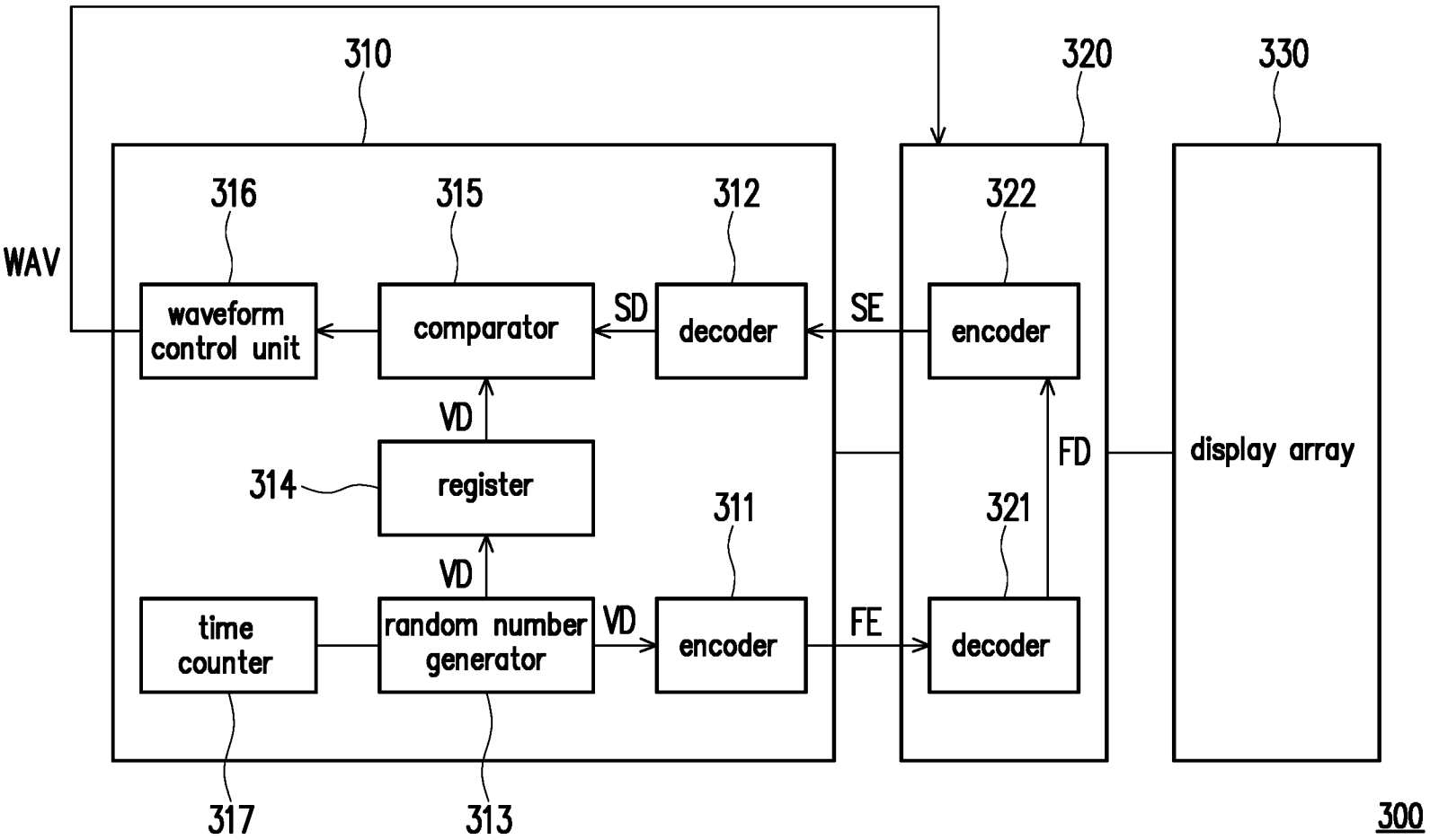
FIG. 3 is a schematic view of a display device according to another embodiment of the disclosure.

FIG. 3 is a schematic view of a display device according to another embodiment of the disclosure. Referring to FIG. 3, a display device 300 includes a timing controller 310, a source driver 320, and a display array 330. In the embodiment of FIG. 3, the display device 300 may be, for example, an electronic paper display device, and the display device 300 has a driving protection mechanism. The timing controller 310 may perform a verification operation on the source driver 320 to determine whether the source driver 320 is a legitimate display driver. When the source driver 320 is confirmed as the legitimate display driver, the timing controller 310 will enable the source driver 320, so as to drive the display array 330 to generate an image.

In the embodiment of FIG. 3, the timing controller 310 includes an encoder 311, a decoder 312, a random number generator 313, a register 314, a comparator 315, a waveform control unit 316, and a time counter 317. The source driver 320 includes a decoder 321 and an encoder 322. The timing controller 310 may adopt the time counter 317 to generate a time parameter according to real-time time information and provide the time parameter to the random number generator 313. The timing controller 310 may adopt the random number generator 313 to generate a set of random number data. The random number generator 313 may encode the time parameter and the random number data to generate a verification data VD, and store the verification data VD in the register 314. For example, the timing controller 310 may, for example, combine the 24-byte time parameter with the 128-byte random number data to generate the 152-byte verification data VD. The timing controller 310 may, for example, encode to increase the data encryption strength according to the order of a part of the 12-byte time parameter, a part of the 64-byte random number data, another part of the another 12-byte time parameter, and another part of the another 64-byte random number data, but the disclosure is not limited thereto. In one embodiment, the timing controller 310 may adopt other specific encoding methods to generate the verification data VD according to user design. Then, in order to improve the security of the verification process, the timing controller 310 may transmit the verification data VD generated by the random number generator 313 to the encoder 311. The encoder 311 may encrypt the verification data VD to generate a first encryption signal FE, and output the first encryption signal FE to the source driver 320. In another embodiment, the random number generator 313 may generate a set of random number data directly as the verification data VD (which may not include the time parameter).

After the source driver 320 receives the first encryption signal FE, the source driver 320 may adopt the decoder 321 to decrypt the first encryption signal FE to obtain a first decryption data FD. At this time, if the source driver 320 directly returns the first decryption data FD to the timing controller 310, there may be a risk of data theft. Therefore, the decoder 321 may transmit the first decryption data FD to the encoder 322, and the encoder 322 encrypts the first decryption data FD to obtain a second encryption signal SE. After the encoder 322 generates the second encryption signal SE, the source driver 320 may output the second encryption signal SE to the timing controller 310 so as to perform identity verification on the source driver 320.

In the embodiment of FIG. 3, the timing controller 310 adopts the parallel transmission method to output the first encryption signal FE to the source driver 320, and the source driver 320 adopts the serial transmission method to output the second encryption signal SE to the timing controller 310. In other embodiments, the timing controller 310 may adopt the serial transmission method to output the first encryption signal FE to the source driver 320, and the source driver 320 may adopt the parallel transmission method to output the second encryption signal SE to the timing controller 310.

Referring to FIG. 3 again, after the timing controller 310 receives the second encryption signal SE, the timing controller 310 may adopt the decoder 312 to decrypt the second encryption signal SE, so as to obtain a second decryption data SD and output the second decryption data SD to the comparator 315. The timing controller 310 may adopt the comparator 315 to read the verification data VD stored in the register 314 to compare whether the verification data VD matches the second decryption data SD. If the comparator 315 determines that the verification data VD matches the second decryption data SD, the comparator 315 may notify the waveform control unit 316 to output a waveform control signal WAV. Note that since the time counter 317 may have a function of uninterrupted power and permanent counting, the time parameter generated by the time counter 317 may not be repetitive. That is to say, the verification data VD generated by combining the time parameter generated by the time counter 317 and the random number data generated by the random number generator 313 is encrypted to generate the first encryption signal FE, and an encryption strength of the first encryption signal FE is better than that of an encryption signal generated simply by the random number data of the random number generator 313.

In this embodiment, the source driver 320 is coupled to an output end of the waveform control unit 316 to receive the waveform control signal WAV. In this way, the source driver 320 may drive the display array 330 according to the waveform control signal WAV to generate an image. Therefore, the disclosure may protect the waveform control signal WAV output by the timing controller 310 through the above verification operation method.

Figure 4:
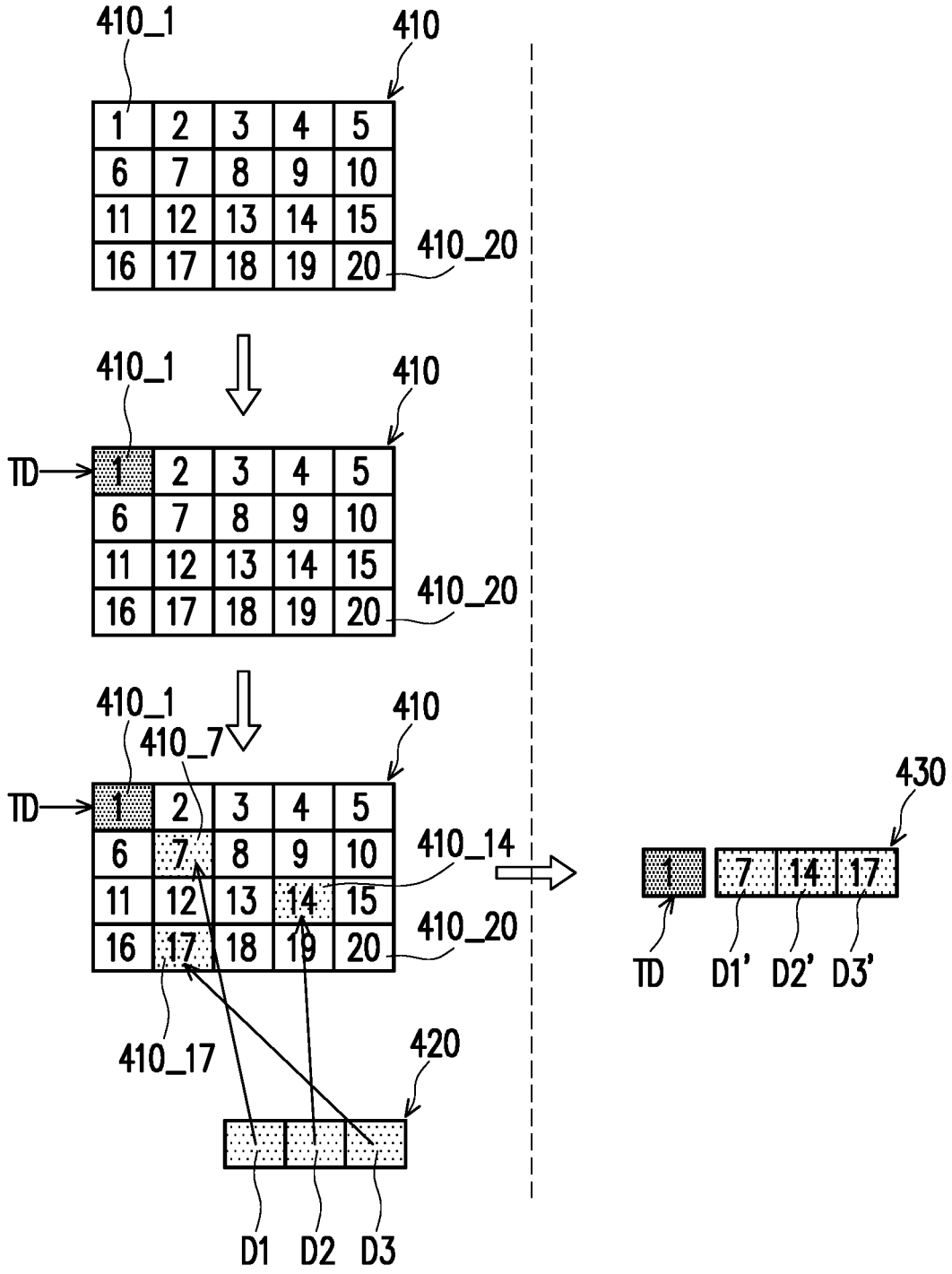
FIG. 4 is a schematic view illustrating performing an encryption operation and a decryption operation according to an embodiment of the disclosure.

FIG. 4 is a schematic view illustrating performing an encryption operation and a decryption operation according to an embodiment of the disclosure. Referring to FIG. 3 and FIG. 4, when the timing controller 310 performs the verification operation on the source driver 320, the timing controller 310 may transmit the verification data VD generated by the random number generator 313 to the encoder 311. The encoder 311 may encrypt the verification data VD to generate the first encryption signal FE. The encoder 311 may adopt an encryption array data 410 of FIG. 4 as the first encryption signal FE.

As shown in FIG. 4, the encryption array data 410 may include multiple bytes. For example, position 1 represents byte 410_1, position 20 represents byte 410_20, and so on. Therefore, the encryption array data 410 of FIG. 4 has 20 bytes. However, in other embodiments, the encryption array data 410 may also include a larger number of bytes. Referring to FIG. 4 again, the encryption array data 410 includes a byte corresponding to a trigger data TD, at least one byte corresponding to a verification data 420 (that is, the verification data VD of FIG. 3), and at least one byte of an invalid data. For example, if the verification data 420 has 152 bytes as in the above embodiment, the encryption array data 410 may be, for example, a 400-byte array data with 20 rows and 20 columns.

In this embodiment, the encoder 311 of the timing controller 310 may preset the byte 410_1 as the trigger data TD. The trigger data TD is configured to determine whether to perform the decryption operation. The encoder 311 may also convert three sub-data D1, D2, and D3 in the verification data 420 into three corresponding bytes 410_7, 410_14, and 410_17. Therefore, the encoder 311 may mix the byte 410_1 and the bytes 410_7, 410_14 and 410_17 in a specific arrangement order (herein referred to as the first arrangement order) in an invalid byte (that is, positions 2 to 6, 8 to 13, 15 to 16, and 18 to 20 in FIG. 4) to form the encryption array data 410.

Referring to FIG. 3 and FIG. 4 again, during the verification operation, the encoder 311 of the timing controller 310 may transmit the first encryption signal FE including the encryption array data 410 to the decoder 321 of the source driver 320. The decoder 321 will first detect the encryption array data 410 to determine whether the encryption array data 410 has the byte 410_1 corresponding to the trigger data TD. If the decoder 321 detects the byte 410_1 corresponding to the trigger data TD in the encryption array data 410, the decoder 321 will perform the decryption operation.

When the decoder 321 performs the decryption operation, the decoder 321 may designate at least one byte in the encryption array data 410 to obtain a first decryption data 430 (that is, the first decryption data FD of FIG. 3). For example, the decoder 321 may designate the byte 410_7 in the encryption array data 410 to obtain a sub-data D1' in the first decryption data 430. The decoder 321 may also designate the byte 410_14 in the encryption array data 410 to obtain a sub-data D2' in the first decryption data 430. The decoder 321 may further designate the byte 410_17 in the encryption array data 410 to obtain a sub-data D3' in the first decryption data 430. In addition, if the decoder 321 does not detect the byte 410_1 corresponding to the trigger data TD in the encryption array data 410, the decoder 321 does not perform the decryption operation.

The implementation that the source driver 320 in FIG. 3 adopts the encoder 322 to perform the encryption operation and the timing controller 310 adopts the decoder 312 to perform the decryption operation may be performed by adopting the operation method similar to the embodiment of FIG. 4, and thus the description is omitted herein.

Figure 5:
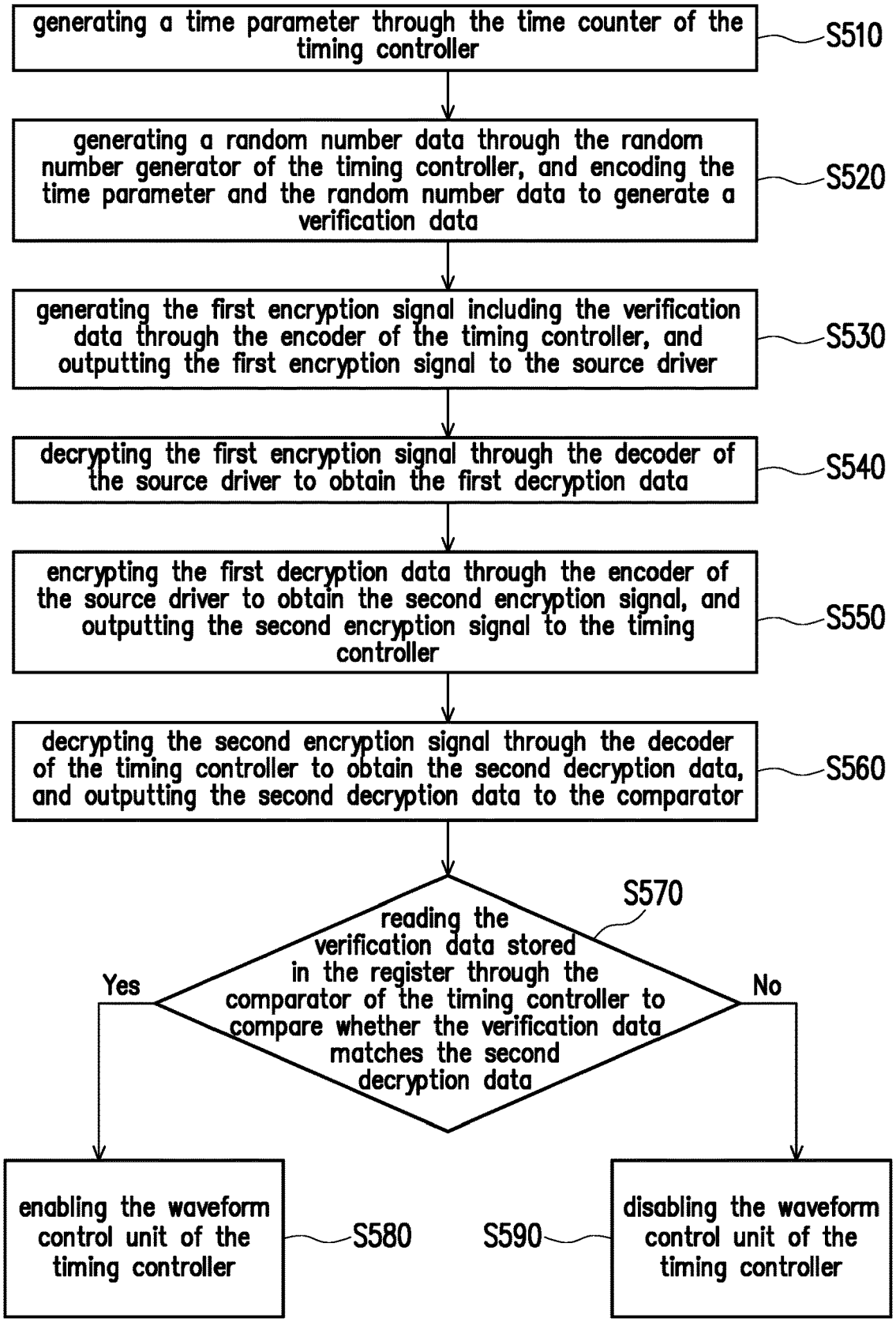
FIG. 5 is a schematic view of a driving protection method according to an embodiment of the disclosure.

FIG. 5 is a schematic view of a driving protection method according to an embodiment of the disclosure. The driving protection method of this embodiment is at least adapted for the display device 300 of the embodiment of FIG. 3. Referring to FIG. 3 and FIG. 5, in step S510, the time counter 317 of the timing controller 310 may generate a time parameter. In step S520, the random number generator 313 of the timing controller 310 may generate the random number data, and encode the time parameter and the random number data to generate the verification data VD. The timing controller 310 may store the verification data VD to the register 314. In step S530, the encoder 311 of the timing controller 310 may generate the first encryption signal FE including the verification data VD, and output the first encryption signal FE to the source driver 320. In step S540, the decoder 321 of the source driver 320 may decrypt the first encryption signal FE to obtain the first decryption data FD.

In step S550, the encoder 322 of the source driver 320 may encrypt the first decryption data FD to obtain the second encryption signal SE, and output the second encryption signal SE to the timing controller 310. In step S560, the decoder 312 of the timing controller 310 may decrypt the second encryption signal SE to obtain the second decryption data SD, and output the second decryption data SD to the comparator 315.

After the comparator 315 receives the second decryption data SD, the comparator 315 of the timing controller 310 may read the verification data VD stored in the register 314 in step S570 to compare whether the verification data VD matches the second decryption data SD. If the verification data VD matches the second decryption data SD, the timing controller 310 may enable the waveform control unit 316 in step S580 to output the waveform control signal WAV. In addition, if the verification data VD does not match the second decryption data SD, the timing controller 310 may disable the waveform control unit 316 in step S590. Therefore, the disclosure may protect the waveform control signal WAV through the above verification operation method.

Based on the above, the display device in the embodiments of the disclosure includes a timing controller and a source driver. The timing controller may perform a verification operation on the source driver to determine whether the current source driver is a legitimate display driver. When the current source driver is confirmed as the legitimate display driver, the timing controller will enable the source driver to perform display driving. Therefore, the display device in the embodiments of the disclosure may provide full protection for some confidential information (for example, a waveform control signal of a display panel) in the image signal. In addition, the timing controller and the source driver in the embodiments of the disclosure have a function of encryption protection. Therefore, when performing a verification operation, it may be ensured that a verification signal transmitted between the timing controller and the source driver is not read by an external device.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A display device, comprising:

a timing controller, configured to encrypt a verification data to generate a first encryption signal; and a source driver, coupled to the timing controller, and configured to receive the first encryption signal, wherein the source driver decrypts the first encryption signal to obtain a first decryption data, and encrypts the first decryption data to generate a second encryption signal, wherein the source driver outputs the second encryption signal to the timing controller, and the timing controller decrypts the second encryption signal to obtain a second decryption data, wherein when the timing controller determines that the second decryption data matches the verification data, the timing controller enables the source driver to perform display driving.

2. The display device according to claim 1, wherein the timing controller generates the first encryption signal comprising a first encryption array data, and the first encryption array data comprises a plurality of first bytes, wherein the plurality of first bytes comprise a byte corresponding to a first trigger data, at least one byte corresponding to the verification data, and at least one byte of a first invalid data, and the byte corresponding to the first trigger data and the at least one byte corresponding to the verification data have a first arrangement order in the first encryption array data, wherein when the source driver determines that the first encryption array data of the first encryption signal comprises the first trigger data, the source driver designates at least one byte in the first encryption array data to obtain the first decryption data.

3. The display device according to claim 1, wherein the source driver generates the second encryption signal comprising a second encryption array data, and the second encryption array data comprises a plurality of second bytes, wherein the plurality of second bytes comprise a byte corresponding to a second trigger data, at least one byte corresponding to the first decryption data, and at least one byte corresponding to a second invalid data, wherein the byte corresponding to the second trigger data and the at least one byte corresponding to the first decryption data have a second arrangement order in the second encryption array data, wherein when the timing controller determines that the second encryption array data of the second encryption signal comprises the second trigger data, the timing controller designates at least one byte in the second encryption array data to obtain the second decryption data.

4. The display device according to claim 1, wherein the timing controller outputs the first encryption signal to the source driver through one of a parallel transmission method and a serial transmission method, and the source driver outputs the second encryption signal to the timing controller through the other of the parallel transmission method and the serial transmission method.

5. The display device according to claim 1, wherein the timing controller comprises a random number generator, and the random number generator is configured to generate a random number data as the verification data.

6. The display device according to claim 1, wherein the timing controller comprises a time counter and a random number generator, and the time counter is coupled to the random number generator, wherein the time counter is configured to generate a time parameter, and the random number generator is configured to generate a random number data, wherein the random number generator encodes the time parameter and the random number data to generate the verification data.

7. A driving protection method, adapted for a display device, wherein the display device comprises a timing controller and a source driver, wherein the driving protection method comprises:

encrypting a verification data through the timing controller to generate a first encryption signal;

receiving the first encryption signal through the source driver, and decrypting the first encryption signal to obtain a first decryption data;

encrypting the first decryption data through the source driver to generate a second encryption signal, and outputting the second encryption signal to the timing controller;

decrypting the second encryption signal through the timing controller to obtain a second decryption data; and when the timing controller determines that the second decryption data matches the verification data, enabling the source driver through the timing controller to perform display driving.

8. The driving protection method according to claim 7, wherein generating the first encryption signal comprises:

generating the first encryption signal comprising a first encryption array data through the timing controller, wherein the first encryption array data comprises a plurality of first bytes, wherein the plurality of first bytes comprise a byte corresponding to a first trigger data, at least one byte corresponding to the verification data, and at least one byte of a first invalid data, and the byte corresponding to the first trigger data and the at least one byte corresponding to the verification data have a first arrangement order in the first encryption array data, wherein obtaining the first decryption data comprises:

when the source driver determines that the first encryption array data of the first encryption signal comprises the first trigger data, designating at least one byte in the first encryption array data through the source driver to obtain the first decryption data.

9. The driving protection method according to claim 7, wherein generating the second encryption signal comprises:

generating the second encryption signal comprising a second encryption array data through the source driver, wherein the second encryption array data comprises a plurality of second bytes, wherein the plurality of second bytes comprise a byte corresponding to a second trigger data, at least one byte corresponding to first decryption data, and at least one byte corresponding to a second invalid data, wherein the byte corresponding to the second trigger data and the at least one byte corresponding to first decryption data have a second arrangement order in the second encryption array data, wherein obtaining the second decryption data comprises:

when the timing controller determines that the second encryption array data of the second encryption signal comprises the second trigger data, designating at least one byte in the second encryption array data through the timing controller to obtain the second decryption data.

10. The driving protection method according to claim 7, wherein the timing controller outputs the first encryption signal to the source driver through one of a parallel transmission method and a serial transmission method, and the source driver outputs the second encryption signal to the timing controller through the other of the parallel transmission method and the serial transmission method.

11. The driving protection method according to claim 7, further comprising:

generating a time parameter through a time counter;

generating a random number data through a random number generator; and encoding the time parameter and the random number data through the random number generator to generate the verification data.

* * * * *